US009000873B2

(12) United States Patent
Deville et al.

(10) Patent No.: US 9,000,873 B2
(45) Date of Patent: Apr. 7, 2015

(54) INDUCTIVE COUPLERS FOR USE IN A DOWNHOLE ENVIRONMENT

(75) Inventors: Benoit Deville, Paris (FR); Yann Dufour, Châtillon (FR); Philippe F. Salamitou, Paris (FR); Jean-Luc Garcia, Courcouronnes (FR); Emmanuel Legendre, Sevres (FR); Eric Grandgirard, Cedex (FR); Nicolas Renoux, Versailles (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 70 days.

(21) Appl. No.: 13/699,737

(22) PCT Filed: Jul. 1, 2011

(86) PCT No.: PCT/EP2011/003436

§ 371 (c)(1),
(2), (4) Date: Mar. 31, 2013

(87) PCT Pub. No.: WO2012/003999

PCT Pub. Date: Jan. 12, 2012

(65) Prior Publication Data

US 2013/0181799 A1 Jul. 18, 2013

Related U.S. Application Data

(60) Provisional application No. 61/361,479, filed on Jul. 5, 2010.

(51) Int. Cl.

| | |
|---|---|
| ***H01F 27/02*** | (2006.01) |
| ***E21B 17/02*** | (2006.01) |
| ***E21B 47/01*** | (2012.01) |
| ***E21B 47/12*** | (2012.01) |
| ***H01F 38/14*** | (2006.01) |

(52) U.S. Cl.
CPC ..... *E21B 17/023* (2013.01); *E21B 17/028* (2013.01); *E21B 47/011* (2013.01); *E21B 47/122* (2013.01); *H01F 38/14* (2013.01)

(58) Field of Classification Search
USPC ..... 336/130–133, 90, 92
See application file for complete search history.

(56) References Cited

U.S. PATENT DOCUMENTS

| | | | |
|---|---|---|---|
| 5,455,573 | A | 10/1995 | Delatorre |
| 5,457,988 | A | 10/1995 | Delatorre |
| 6,459,383 | B1 | 10/2002 | Delatorre |

(Continued)

FOREIGN PATENT DOCUMENTS

| | | |
|---|---|---|
| GB | 1096388 | 12/1967 |

OTHER PUBLICATIONS

International Search Report for the equivalent PCT patent application No. PCT/EP2011/003436 issued on Dec. 7, 2012.

*Primary Examiner* — Tuyen Nguyen
(74) *Attorney, Agent, or Firm* — Cameron R. Sneddon

(57) ABSTRACT

Inductive couplers for use in a downhole environment are described. An example inductive coupler for use in a downhole environment includes a body defining a cavity and magnetic material positioned in the cavity. The example inductive coupler also includes a coil adjacent the magnetic material, the coil formed with a number of turns of wire, and a first metal cover coupled to the body to enclose the cavity. The metal cover being electrically coupled to the body to form a substantially contiguous electrically conductive surface surrounding the cavity.

24 Claims, 10 Drawing Sheets

(56) References Cited

U.S. PATENT DOCUMENTS

| | | | | |
|---|---|---|---|---|
| 7,735,555 | B2 | 6/2010 | Patel et al. | |
| 7,902,955 | B2 | 3/2011 | Veneruso et al. | |
| 2005/0218898 | A1 * | 10/2005 | Fredette et al. | 324/342 |
| 2007/0029112 | A1 | 2/2007 | Li et al. | |
| 2007/0079988 | A1 | 4/2007 | Konschuh et al. | |
| 2010/0200291 | A1 | 8/2010 | Patel et al. | |
| 2010/0236774 | A1 | 9/2010 | Patel et al. | |

* cited by examiner

INDUCTIVE COUPLERS FOR USE IN A DOWNHOLE ENVIRONMENT

RELATED APPLICATION

This patent claims the benefit of U.S. Provisional Patent Application No. 61/361,479 filed Jul. 5, 2010, which is hereby incorporated herein by reference in its entirety.

FIELD OF THE DISCLOSURE

This patent relates generally to inductive couplers and, more specifically, to inductive couplers for use in a downhole environment.

BACKGROUND

A completion system is installed in a well to produce hydrocarbon fluids, commonly referred to as oil and gas, from reservoirs adjacent the well or to inject fluids into the well. In many cases, the completion system includes electrical devices that have to be powered and which communicate with an earth surface or downhole controller. Traditionally, electrical cables are run to downhole locations to enable such electrical communication and power transfers. Additionally or alternatively, inductive couplers may be used in the downhole environment in connection with completion systems to enable the communication of power and/or telemetry between electrical devices in a wellbore and the surface.

DETAILED DESCRIPTION

Figure 1:
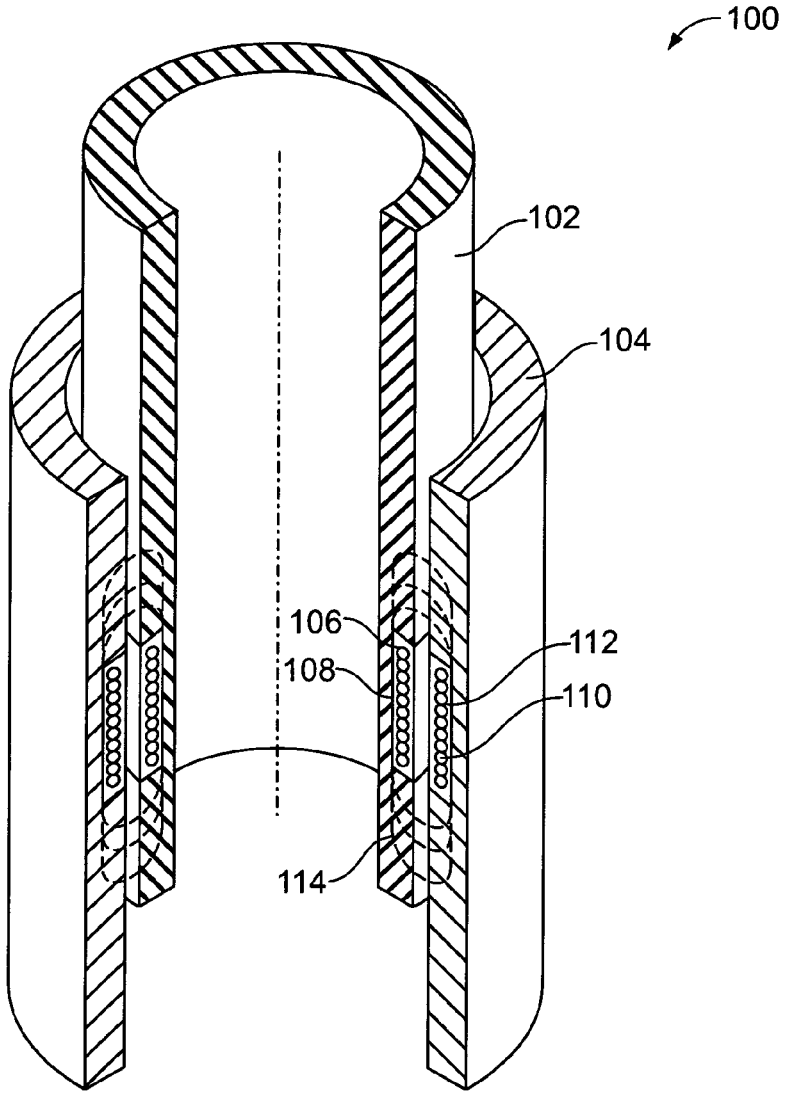
FIG. 1 PRIOR ART
FIG. 1 depicts a known inductive coupling.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples described herein relate to male and female inductive couplers that are configured for use in a downhole environment and, specifically, for use with hydrocarbon completion assemblies. The examples described herein enable components positioned in a cavity of an inductive coupler(s) to be isolated from wellbore fluids and/or gases using a metallic layer and/or sleeve that may be electrically coupled to a body of the inductive coupler by welding and/or brazing such that the metallic sleeve provides a substantially contiguous electrically conductive surface that surrounds the cavity. The welding may be performed using electron beam welding, plasma welding, TIG welding, etc. The metallic sleeve may be substantially non-permeable to gas and may not require additional seals (e.g., O-rings) to prevent the infiltration of wellbore fluids (e.g., liquids and/or gases into the cavity). In some examples, the metallic sleeve may have a thickness of between about 0.1 and 0.4 millimeters (mm) and may include a super alloy such as an austenitic nickel-chromium-based super alloy.

To enable the male and female inductive couplers to be inductively coupled while using a metallic sleeve to enclose the cavity, a number of turns of an electrically conductive material (e.g., wire) forming the coil, a length of the coil, a length of the magnetic material and/or a number of coils used may be increased compared to known inductive couplers. More specifically, various parameters such as materials type(s), geometry, thickness, etc., may be varied and/or selected to achieve a coupling efficiency of greater than 80%, for example. In particular, a number of turns of wire used to form a coil and the material type and thickness for the metallic sleeve or shield may be selected to achieve a coupling efficiency of 80%. Some known inductive couplers use one coil for both telemetry and power that has between about 54 and 80 turns of wire or other suitable electrically conductive material while the example inductive couplers described herein may use two coils each having a substantially greater number of turns than the known inductive couplers. For the two coil examples described herein, one of the coils may be used for telemetry and may have between about 200 turns and 400 turns while the other coil may be used for power and may have between about 1,000 turns and 10,000 turns. However, any other number of turns may be used and/or any other number of coils (e.g., 1, 2, 3, etc.) may be used in connection with the examples described herein to enable more than 30% and/or more than 50% of the current generated to pass to an adjacent coupler (e.g., greater than a 30% and/or 50% and/or 80% coupling efficiency). Because the coil used for power may have a relatively high number of turns, the power may be transmitted at a relatively low frequency. Also, because of the number of turns on the coil used for telemetry and/or the metallic sleeve surrounding this coil, telemetry may be transmitted at higher frequency. The wire or other electrically conductive material used for the coil may be insulated copper wire having a diameter of approximately 0.65 mm or any other suitable thickness. In other words, it is an object of the disclosure to arrive at a number of turns in the coil and/or coupler to overcome the short, the loss or electrical path created by the metallic sleeve to achieve a coil and/or coupler having at least a 50% and/or 80% efficiency.

To enable the magnetic material, the coil and/or the body of the inductive coupler to have similar thermal expansion characteristics, the cavity in which the magnetic material and the coil are positioned may be filled with a filler. The filler may, for example, include resin, varnish, epoxy, non-conductive fluid, dielectric oil and/or fiberglass. In examples in which the filler is a fluid and/or oil, the metallic sleeve and/or a portion of the inductive coupler body may include metallic bellows and/or a pressure compensating member(s) to adjust and/or compensate for variations in the fluid and/or oil volume caused by temperature and/or pressure variations in the downhole environment.

The inductive couplers described herein may also include a secondary layer and/or sleeve adjacent an exterior surface of the metallic sleeve to protect the metallic sleeve from damage when positioned in a downhole environment. The additional layer may be an electrically non-conductive material or a secondary metallic layer or sleeve (e.g., a cage, a slotted cage, etc.) defining one or more slots. If the additional layer is a secondary metallic sleeve, an insulation and/or isolation layer (e.g., fiberglass) may be positioned between the metallic sleeve and the secondary metallic sleeve to substantially prevent the formation of an electrically conductive path between the metallic sleeve and the secondary metallic sleeve.

FIG. 1 depicts a known inductive coupler 100 that includes a male coupling 102 and a female coupling 104. To enable the male coupling 102 to be lowered into and/or positioned within the female coupling 104, the male coupling 102 has an outer diameter that is smaller than an inner diameter of the female coupling 104. To enable power and/or information to be conveyed via induction between the male and female couplings 102 and 104, the male coupling 102 includes a coil 106 and a magnetic core 108 that are aligned with a coil 110 and a magnetic core 112 of the female coupling 104.

In practice, a magnetic field 114 is created by running electrical current through one of the coils 106 and/or 110 that induces a current to flow in the opposing coil 106 and/or 110. However, this known configuration exposes the coils 106 and/or 110 and the magnetic cores 108 and/or 112 to wellbore fluids that may reduce the lifespan and/or effectiveness of the inductive coupler 100. Other known examples may at least initially prevent the exposure of the coils 106 and/or 110 and the magnetic cores 108 and/or 112 to wellbore fluids using an elastomeric, plastic or ceramic enclosure. However, deficiencies also exist with such known examples. For example, over time, elastomeric and/or plastic enclosures are permeable to gas and may require seals (e.g., O-rings) that are susceptible to wear and leakage.

Figure 2:
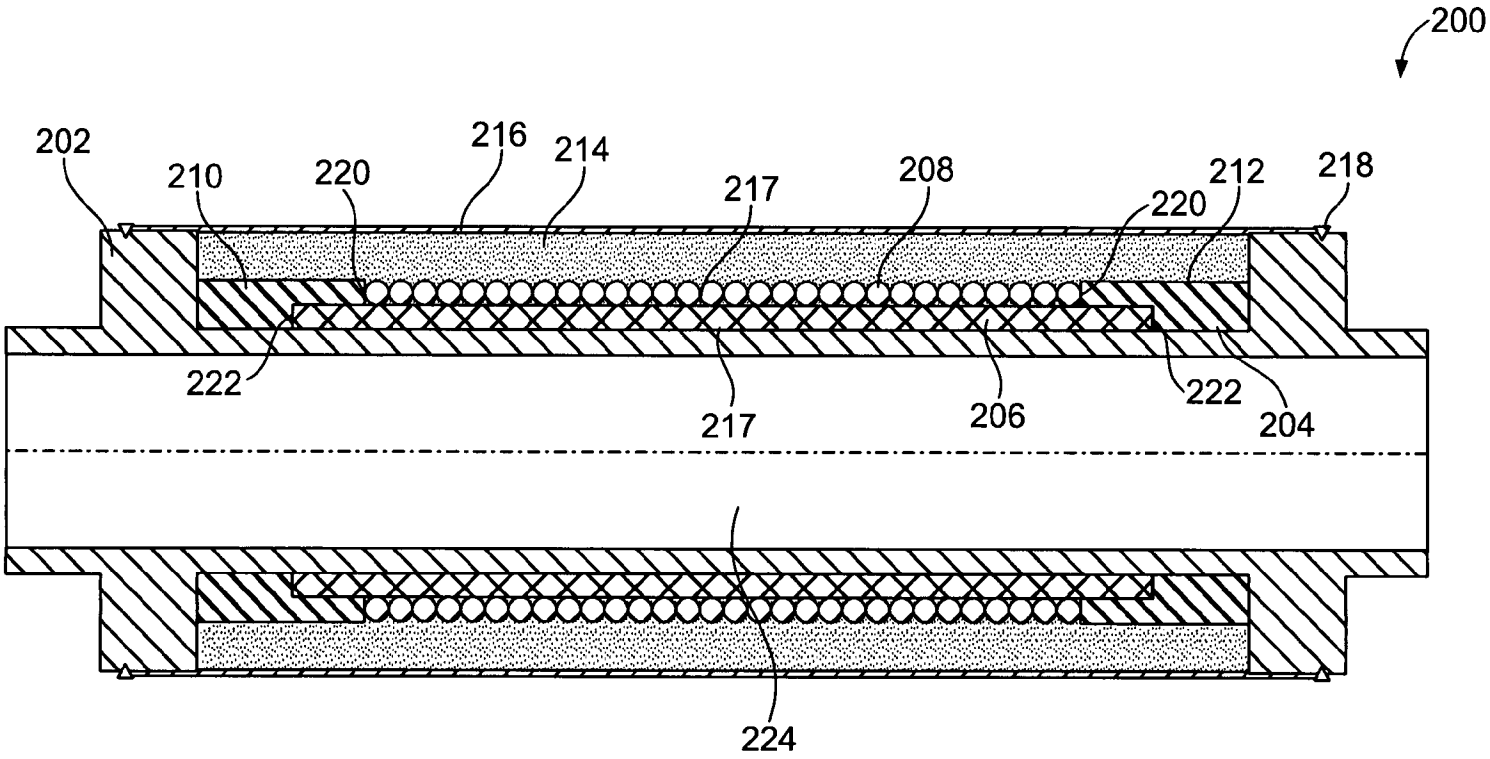
FIG. 2 depicts an example male inductive coupler.

FIG. 2 depicts an example male inductive coupler 200 having a body or mandrel 202 that defines a groove or cavity 204. The body 202 may be cylindrically shaped and made of a metal material such a super alloy (e.g., Inconel® 935) and the groove or cavity 204 may be defined circumferentially around the body 202. A magnetic core or material 206, a coil 208, spacers 210 and 212 and filler 214 may be positioned within the cavity 204 and a metallic cover or sleeve 216 may enclose the cavity 204. In some examples, fiberglass fabric or material 217 may be positioned between the body 202, the magnetic core 206, the coil 208, the filler 214 and/or the metallic cover 216. The fiberglass material 217 positioned between any of the body 202, the magnetic core 206, the coil 208, the filler 214 and/or the metallic cover 216 may have similar or different weaves, weight rates, fiber counts, and/or thicknesses. The fiberglass material 217 may be fiberglass E and may be coated with aminosilane and/or FT970 aminosilane.

The metallic cover 216 may be coupled to the body 202 via a weld(s) or braze(s) 218 such that the metallic cover 216 is electrically coupled to the body 202. The metallic cover 216 may have a thickness of between about 0.1 mm and 0.5 mm or any other suitable thickness and may be made of a metal material having relatively low conductivity. The metallic cover 216 may be made of a super alloy(s) that includes nickel, molybdenum, chromium, cobalt, iron, copper, manganese, titanium, zirconium, carbon, tungsten, austenitic, carbon, silicon, sulfur, phosphorus, niobium, tantalum, and/or aluminum. In some examples, the metallic cover 216 may be made of Hastelloy® C276, Hastelloy® B, Inconel® 625, Inconel® alloy 600 and/or Inconel® 935.

The magnetic core 206 may have a length of approximately 200 mm and the coil 208 may have a length of approximately 150 mm. In such examples, the coil 208 may be centered on the magnetic core 206 such that ends 220 of the coil 208 are respectively positioned 25 mm from ends 222 of the magnetic core 206. However, the magnetic core 206 and/or the coil 208 may be positioned differently and may have any other length depending on the length of the cavity 204. The magnetic core 206 may be made of ferrite (e.g., MN80 ferrite) and may include one or more pieces and/or segments. The coil 208 may include a plurality of turns of wire such as between 200 turns and 10,000 turns or any other suitable number of turns. While FIG. 2 depicts the coil 208 having one layer, the coil 208 may have any other number of layers (e.g., 1, 2, 3, etc.). In examples in which the coil includes multiple layers, fiberglass fabric or material may be positioned between the layers. The wire may be an insulated copper wire (e.g., copper and enamel, copper wire 80% by volume) having a diameter of approximately 0.65 mm or any other suitable diameter. In some examples, the inductive coupler 200 is configured to convey both power and telemetry. However, in other examples, the inductive coupler 200 is used for one of power or telemetry.

The spacers 210, 212 may be used to secure the magnetic core 206 relative to the body 202, to increase the efficiency of the inductive coupler 200 and/or to minimize the interaction between the magnetic field generated by the coil 208 and the body 202. The spacers 210, 212 may be made of an electrically non-conductive material such as polyether ether ketone (PEEK), glass and/or epoxy.

To minimize spaces or voids within the cavity 204 between the body 202, the magnetic core 206, the coil 208 and/or the metallic cover 216, the filler 214 may be added to the cavity 204. The filler 214 may have a relatively low thermal expansion value such as between about 14 ppm and 46 ppm. The filler 214 may be made of a relatively low conductivity material such as an encapsulant, an electrically insulating material, a thermally conductive epoxy encapsulant, a thermally conductive electrically insulating epoxy, a binder, varnish, a non-conductive fluid, dielectric oil, a non-metallic material and/or fiberglass. In some examples, the filler 214 may include Epoxy LY8615, Stycast® 2762, Elantas ®MC440WH, Hysol® FP4450, Epo-tek® H470, Huntsman® Rhodeftal 200, Elantas® FT2004, Elantas® FT2006, etc. In other examples, material such as silica flour, glass, diamond, ceramic (low thermal expansion materials) may be added to the filler 214, in an effort to reduce or match the thermal expansion of the cavity.

In examples in which the filler 214 includes varnish and epoxy, the varnish may be added to the cavity 204 to fill spaces or voids between turns of the coil 208 and the epoxy may be added to the cavity 204 to fill spaces between the body 202, the magnetic core 206, the coil 208 and/or the metallic cover 216. Additionally or alternatively, a filler 224 may be added (e.g., injected under vacuum) to the interior of the body 202. The filler 224 may protect the body 202 from damage and/or fill in spaces within the body 202. The filler 224 may include resin, epoxy, amine epoxy, a fluorsilicon solvent resistant sealant, a high temperature and chemical resistant resin, Amine Epoxy 8615, Fluorosilicon Dow Corning® 730, etc.

Figure 3:
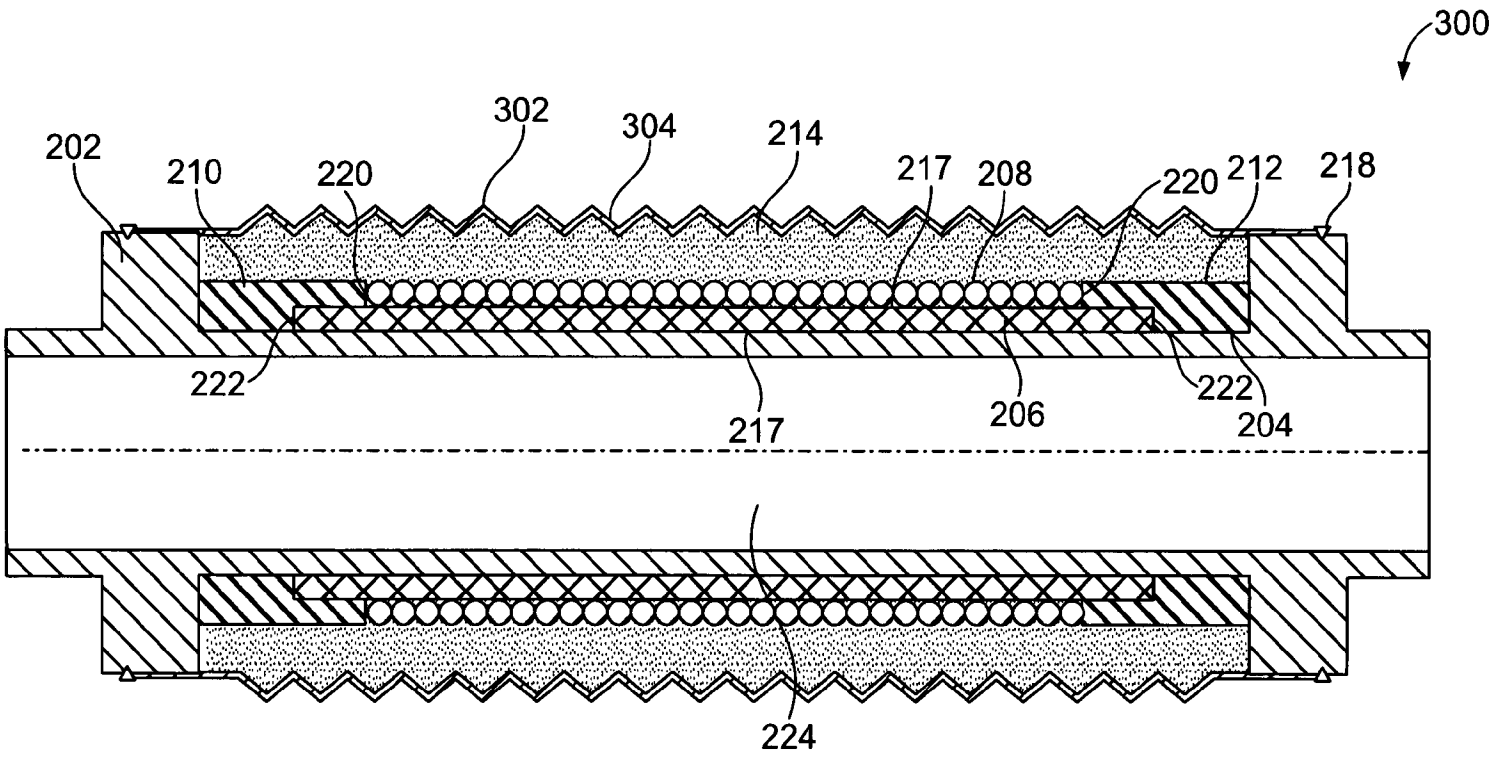
FIG. 3 depicts another example male inductive coupler.

FIG. 3 depicts an example male inductive coupler 300 that is similar to the inductive coupler 200. However, in contrast to the inductive coupler 200, the inductive coupler 300 of FIG. 3 includes an example metallic sheet or sleeve 302 having bellows or a pressure compensating member 304. The bellows 304 may include a plurality of diaphragms coupled together that enable the inductive coupler 300 to better compensate for pressure and/or temperature variations in a downhole environment. For example, if the filler 214 is a fluid and/or oil, the bellows 304 may enable the inductive coupler 300 to compensate for changes in the fluid and/or oil volume in the downhole environment.

Figure 4:
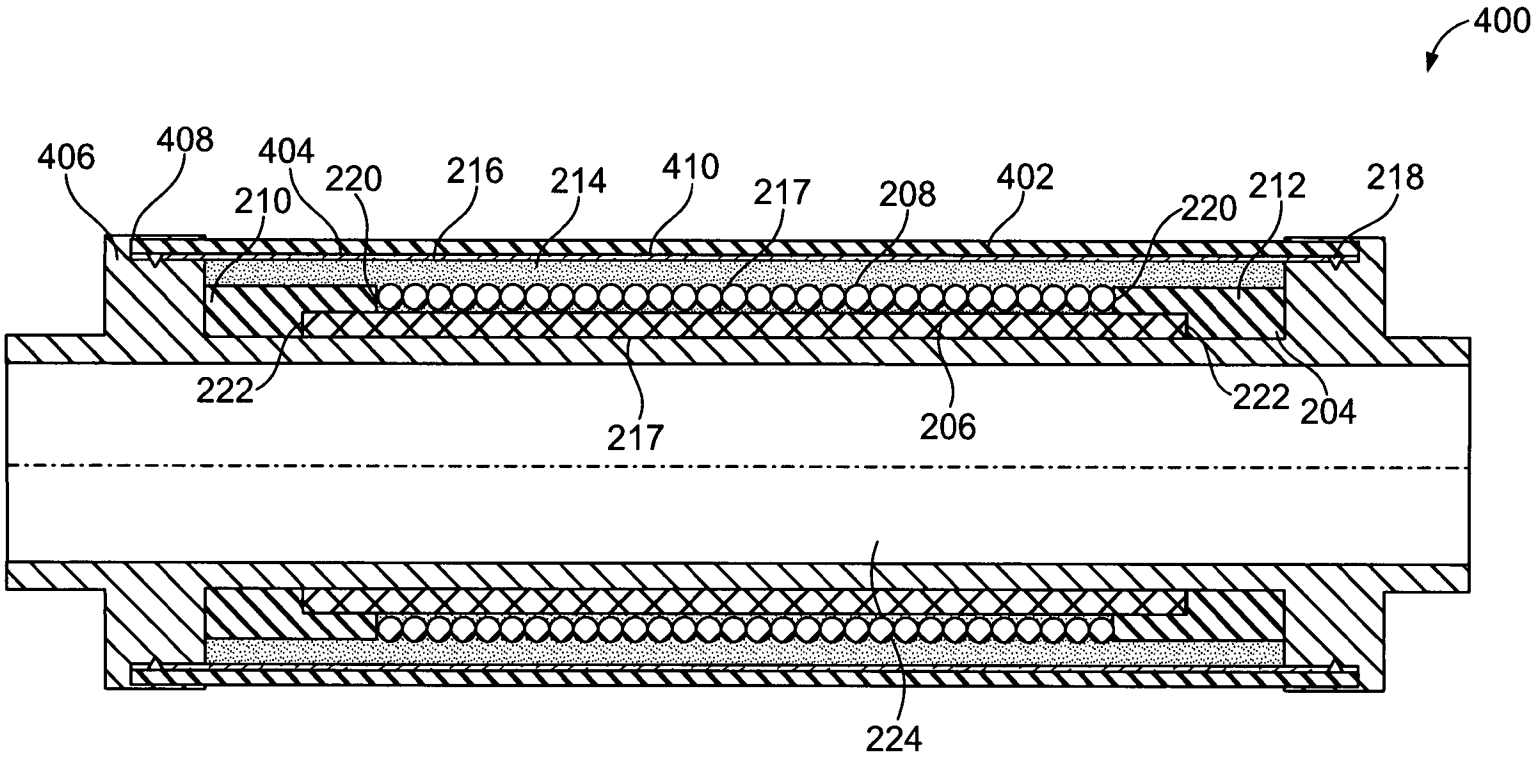
FIG. 4 depicts another example male inductive coupler.

FIG. 4 depicts an example male inductive coupler 400 that is similar to the inductive coupler 200. However, in contrast to the inductive coupler 200, the inductive coupler 400 of FIG. 4 includes a layer or sleeve 402 of electrically non-conductive material adjacent an exterior surface 404 of the metallic cover 216. The layer 402 may protect the metallic cover 216 from physical damage and/or an impact in the downhole environment. A body or mandrel 406 of the inductive coupler 400 may define a groove or cavity 408 into which the layer 402 is positioned to secure the layer 402 relative to the body 406. The electrically non-conductive material may be polyether ether ketone, polyEtherKetone, a fluoroelastomer, a perfluoro-elastomer, ceramic, etc., having any suitable thickness.

Figure 5:
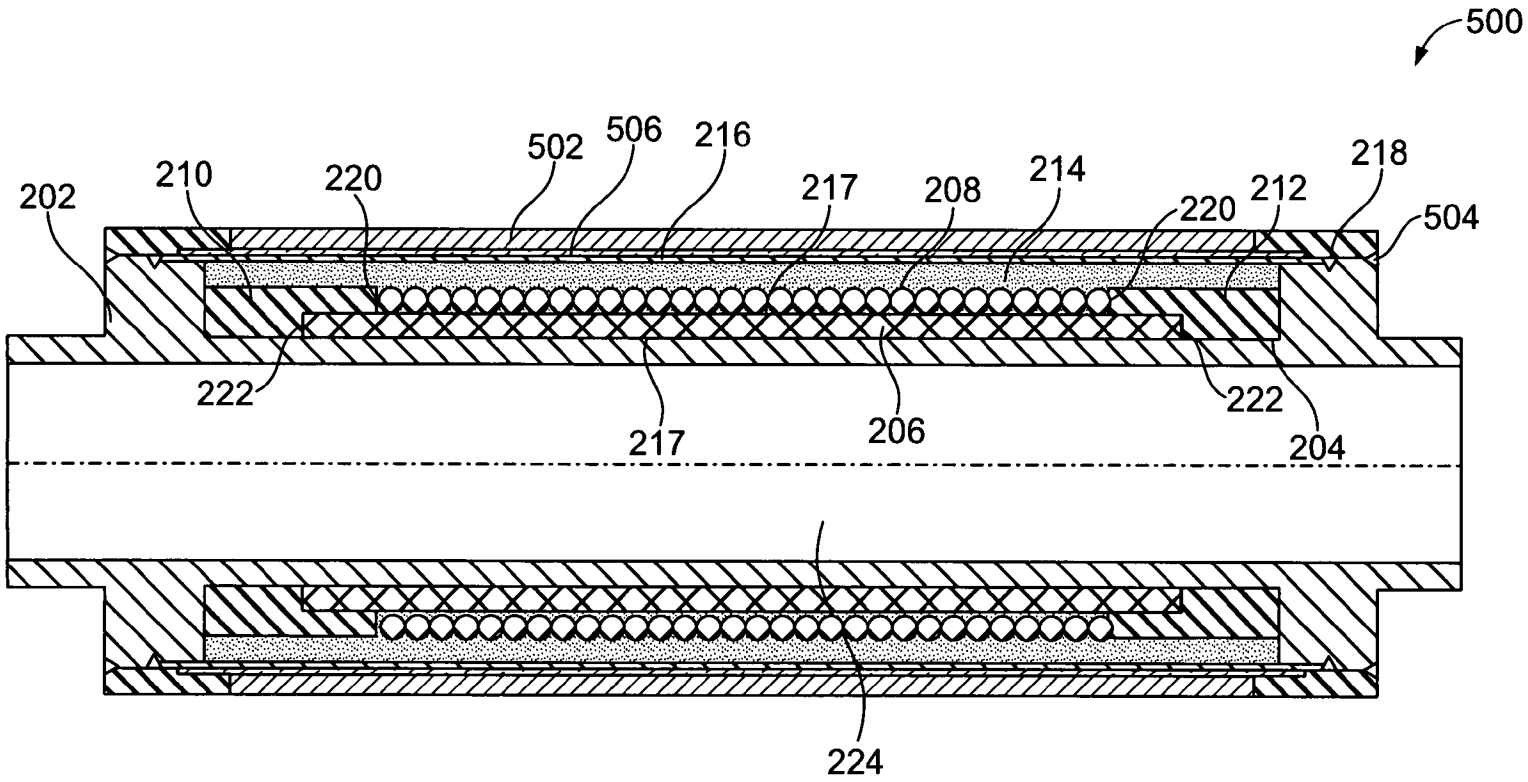
FIG. 5 depicts another example male inductive coupler.

FIG. 5 depicts an example male inductive coupler 500 that is similar to the inductive coupler 200. However, in contrast to the inductive coupler 200, the inductive coupler 500 of FIG. 5 includes a slotted secondary metallic layer or sleeve 502 that may surround and/or substantially surround the metallic cover 216. Slots of the secondary metallic sleeve 502 may be sized and/or have a length to prevent or inhibit the formation of electrical path in the sleeve 502. As such, the sleeve 502 is prevented from providing an addition current path. In particular, the length of the slots should be the length of the coil plus some distance. This distance may be reduced depending on the number of slots. For example, as the number of slots in the metallic sleeve 502 increases, the shorter the distance can be made—and vice versa. The secondary metallic sleeve 502 may be coupled to the body 202 by a weld(s) or braze(s) 504 and may protect the metallic cover 216 from physical damage and/or an impact in the downhole environment. The weld 504 may be spaced from the weld 218 to substantially prevent the formation of an electrically conductive path between the sleeve 502 and the cover 216. The secondary metallic sleeve 502 may have a thickness greater than the thickness of the metallic cover 216 and may be made of a metal having relatively low electrical conductivity and/or a super alloy(s) that includes nickel, molybdenum, chromium, cobalt, iron, copper, manganese, zirconium, carbon, tungsten, austenitic, carbon, silicon, sulfur, phosphorus, titanium, niobium, tantalum, and/or aluminum. In some examples, an isolation or insulation layer (e.g., fiberglass) 506 may be positioned between the secondary metallic sleeve 502 and the metallic cover 216 to substantially prevent the formation of an electrically conductive path between the sleeve 502 and the cover 216.

Figure 6:
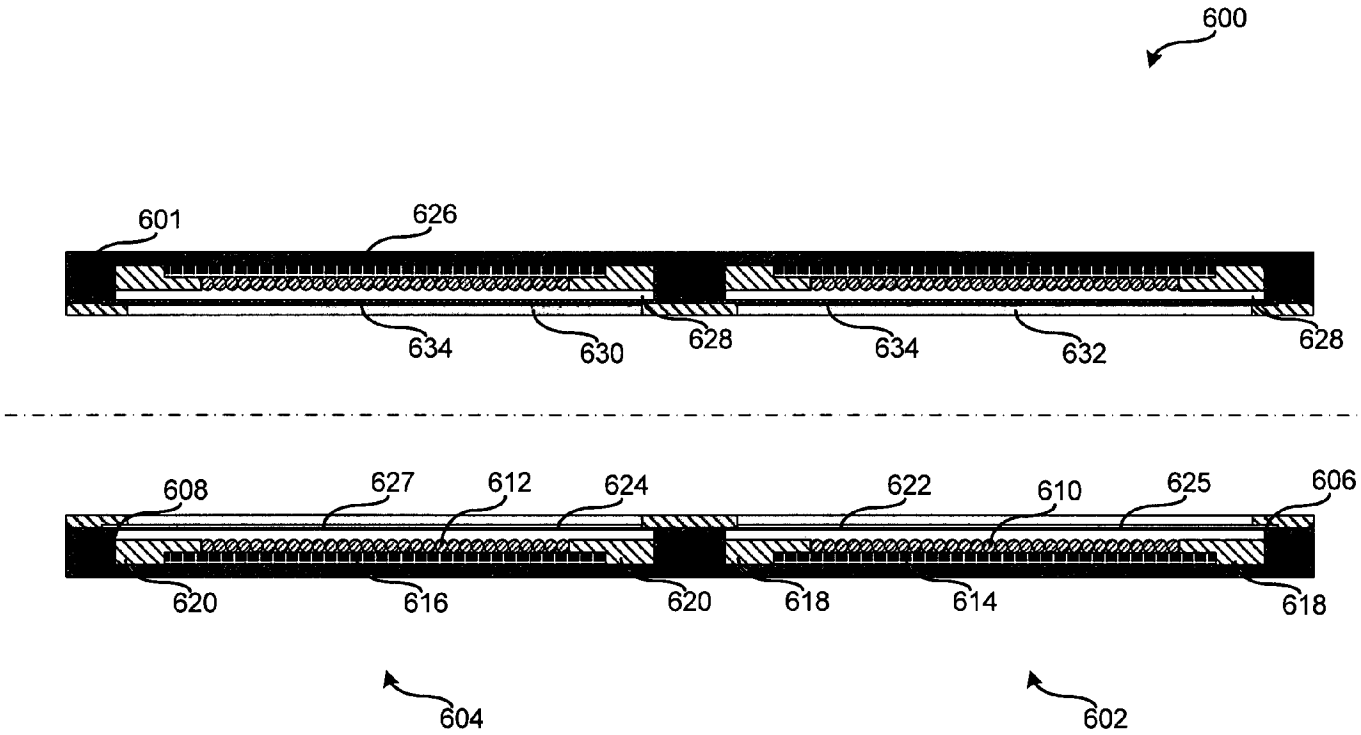
FIGS. 6-8 depict different views of an example female inductive coupler.

FIG. 6 depicts an example female inductive coupler assembly 600 including a first female inductive coupler 602 and a second female inductive coupler 604. The first inductive coupler 602 may be used to convey and/or receive communications and/or telemetry from an opposing first male inductive coupler and the second inductive coupler 604 may be used to convey and/or receive power from an opposing second male inductive coupler.

The inductive coupler assembly 600 includes a body 601 that defines a first recess, groove or cavity 606 and a second recess, groove or cavity 608. Components of the first inductive coupler 602 may be positioned in the first groove or cavity 606 and components of the second inductive coupler 604 may be positioned in the second groove or cavity 608. The components of the first and second inductive couplers 602 and 604 may include coils 610 and 612, magnetic material 614 and 616 and spacers 618 and 620. Inner surfaces 622 and 624 may be surfaces of respective metallic sleeves or covers 625 and 627 that may be brazed, welded or otherwise coupled to the body 601. The grooves or cavities 606 and/or 608 may be filled with a filler 628 as described above and the cover 626 (best seen in FIG. 7) and/or the metallic sleeves 625 and/or 627 may be coupled (e.g., electrically coupled) to the body 601. In some examples, a slotted secondary metallic layer or sleeve 630, 632 may be inserted into or be part of the housing 601 to protect the metallic sleeves or covers 625 and 627. As such, the coupler assembly 600 may also include one or more isolation layers 634 between the metallic sleeves or covers 625 and 627 and the sleeve 630, 632 to prevent a short circuit or additional energy loss.

Figure 7:
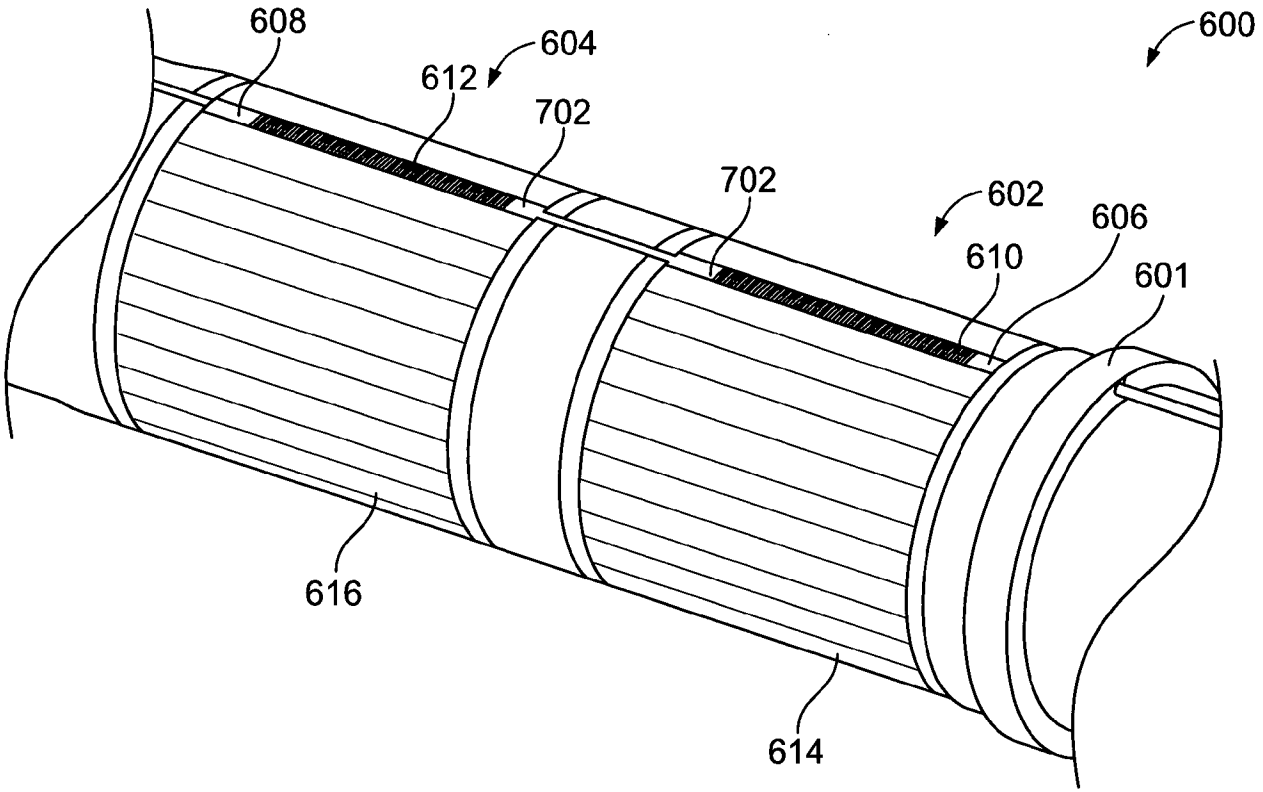

FIG. 7 depicts a perspective view of a portion of the female inductive coupler assembly 600 without the cover 626. As shown, each of the inductive couplers 602 and 604 may include the magnetic material 614 and 616 made of a plurality of different segments or pieces. Additionally, each of the inductive couplers 602 and 604 may include the coils 610 and 612, which may surround the body 601 and/or the metallic sleeves 625 and/or 627 in the respective grooves or cavities 606 and 608. In some examples, fiberglass fabric or material and/or epoxy, etc. 702 may be positioned between the body 601, the metallic sleeves 625 and/or 627, the coils 610 and/or 612, the magnetic materials 614 and/or 616, the filler 628 and/or the cover 626.

Figure 8:
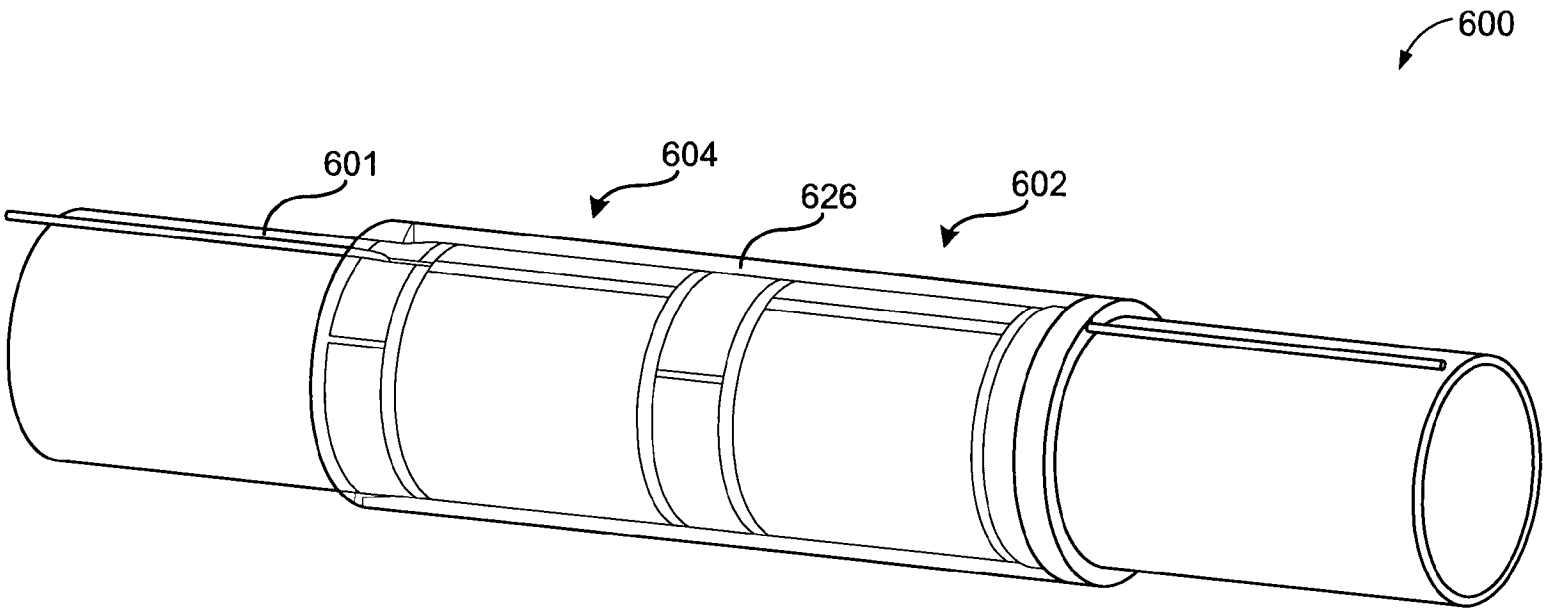

FIG. 8 depicts a perspective view of a portion of the female inductive coupler assembly 600 with the cover 626. The cover 626 may be coupled to the body 601 using any suitable method such as welding and/or brazing and may be used to maintain pressure and/or tension within the inductive coupler assembly 600. The cover 626 may be made of a non-metallic material and/or a super alloy(s) that includes nickel, molybdenum, chromium, cobalt, iron, copper, manganese, zirconium, carbon, tungsten, austenitic, carbon, silicon, sulfur, phosphorus, titanium, niobium, tantalum, and/or aluminum. In some examples, the cover 626 may made of Hastelloy® C276, Hastelloy® B, Inconel® 625, Inconel® alloy 600 and/or Inconel® 935.

Figure 9:
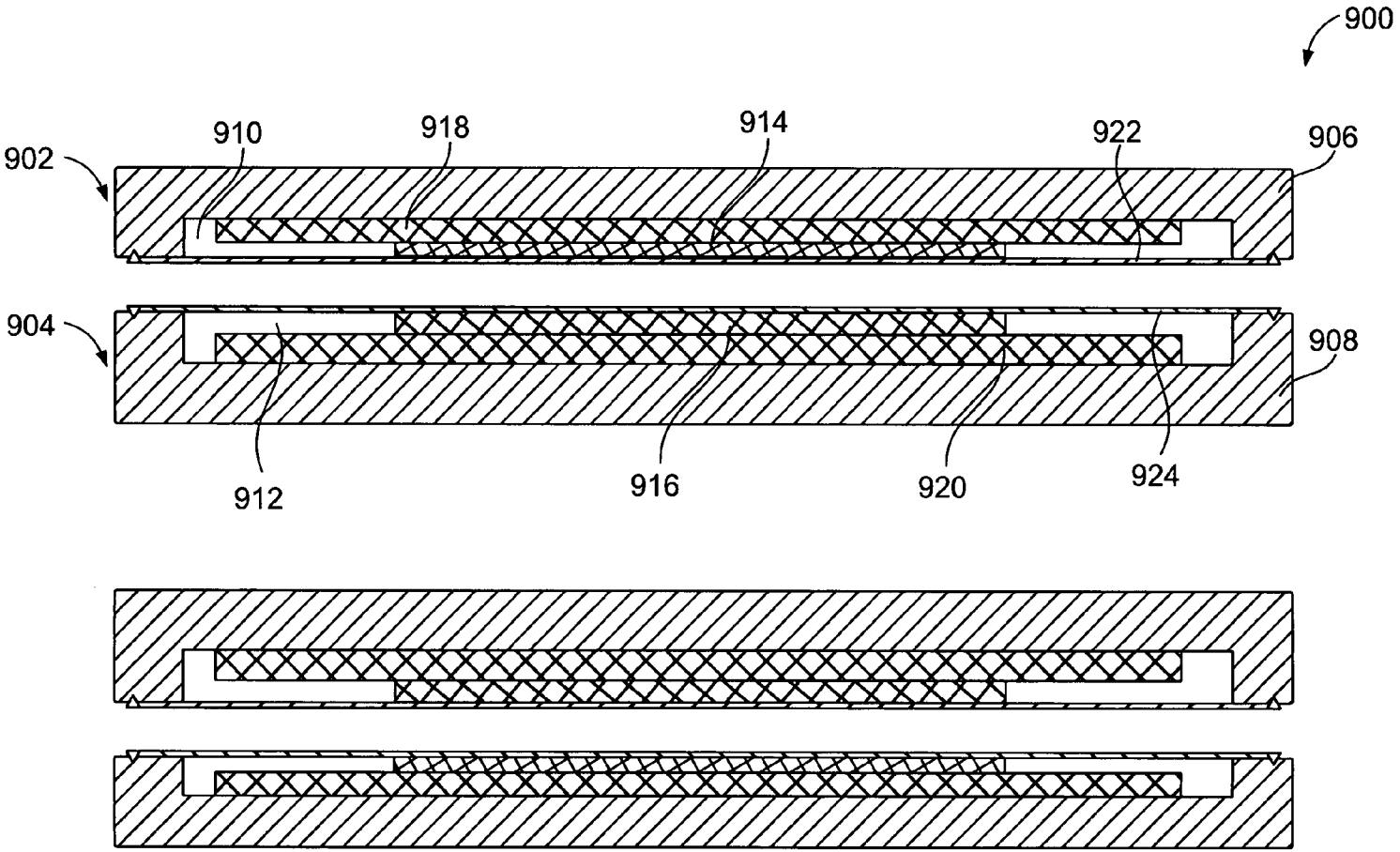
FIGS. 9 and 10 depict different views of an example inductive coupling.

FIG. 9 depicts an example inductive coupling 900 including a female inductive coupler 902 and a male inductive coupler 904. To enable the male inductive coupler 904 to be lowered into and/or positioned within the female inductive coupler 902, the male inductive coupler 904 may have a smaller outer diameter than an inner diameter of the female inductive coupler 902. The male and female inductive couplers 902 and 904 include bodies 906 and 908 that define recesses, grooves or cavities 910 and 912 into which opposing coils 914 and 916 and opposing magnetic materials 918 and 920 are positioned. Respective metallic covers 922 and 924 may be coupled to the bodies 906 and 908 to provide a substantially contiguous electrically conductive surface surrounding the grooves or cavities 910 and 912. In practice, a magnetic field may be created by running electrical current through one of the coils 914 and/or 916 that induces a current to flow in the opposing coil 914 and/or 916.

Figure 10:
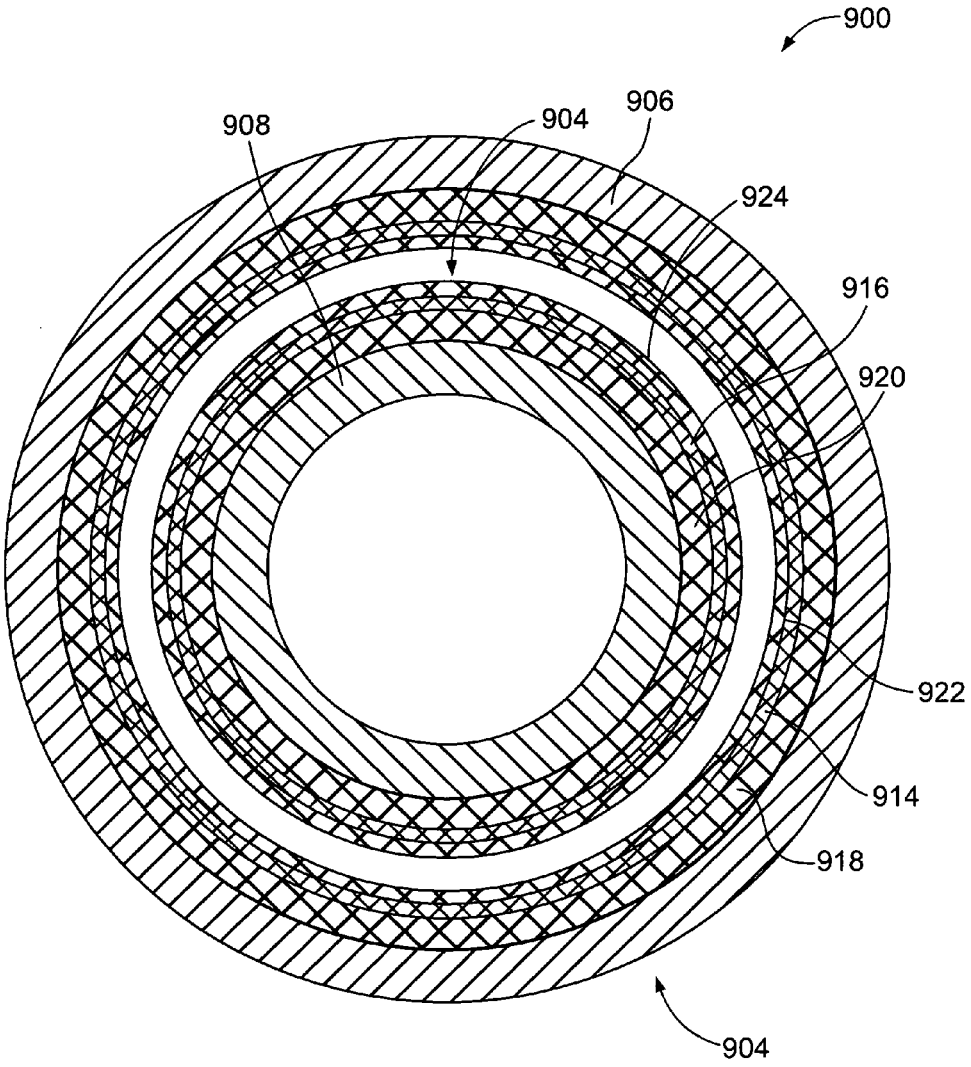

FIG. 10 depicts the inductive coupling 900. As illustrated, the male inductive coupler 904 includes the metallic cover 924 coupled to an inner surface of the body 908.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An inductive coupler for use in a downhole environment, the inductive coupler comprising:

a body defining a cavity;

magnetic material positioned in the cavity;

a coil adjacent the magnetic material, the coil formed with a number of turns of wire, the number being at least 200 turns of wire; and a first metal cover coupled to the body to enclose the cavity, the metal cover being electrically coupled to the body to form a substantially contiguous electrically conductive surface surrounding the cavity.

2. The inductive coupler of claim 1, wherein the first metal cover is coupled to the body by at least one of welding or brazing.

3. The inductive coupler of claim 1, further comprising a layer of electrically non-conductive material adjacent an exterior surface of the first metal cover.

4. The inductive coupler of claim 1, further comprising a second metal cover defining one or more slots and an isolation layer, the isolation layer to be positioned between the first metal cover and the second metal cover.

5. The inductive coupler of claim 4, wherein the isolation layer is to substantially prevent an electrically conductive path between the first metal cover and the second metal cover.

6. The inductive coupler of claim 4, wherein the second metal cover comprises a sleeve.

7. The inductive coupler of claim 1, wherein the first metal cover comprises a thickness of between about 0.1 millimeters and 0.5 millimeters.

8. The inductive coupler of claim 1, further comprising a fiberglass material positioned between at least two of the body, the magnetic material, the coil, or the first metal cover.

9. The inductive coupler of claim 1, wherein the body defines an inner portion filled with resin.

10. The inductive coupler of claim 9, wherein the resin comprises a high temperature and chemical resistant material.

11. The inductive coupler of claim 1, further comprising a filler to fill one or more spaces between the body, the magnetic material, the coil, and the first metal cover.

12. The inductive coupler of claim 11, wherein the filler enables the body, the magnetic material, and the coil to have similar thermal expansion characteristics.

13. The inductive coupler of claim 1, further comprising varnish and resin, wherein the varnish fills spaces between the turns and wherein the resin fills spaces between at least two of the body, the magnetic material, the coil, or the first metal cover.

14. The inductive coupler of claim 1, wherein the coil comprises a plurality of coil layers.

15. The inductive coupler of claim 14, further comprising fiberglass fabric between at least a first and a second coil layer.

16. The inductive coupler of claim 1, wherein the body comprises a metal material.

17. The inductive coupler of claim 1, wherein the magnetic material comprises one or more magnetic segments.

18. The inductive coupler of claim 1, wherein the number of turns of wire comprises between about 200 turns and 10,000 turns.

19. The inductive coupler of claim 1, wherein the coil is formed with the number of turns of the wire to enable more than 30% of current generated by the coil to pass to another inductive coupler

20. The inductive coupler of claim 1, wherein the number of turns of the wire and a thickness of the first metal cover are selected to provide a coupling efficiency of greater than 80%.

21. An inductive coupler for use in a downhole environment, the inductive coupler comprising:

a body defining a cavity;

magnetic material positioned in the cavity;

a coil adjacent the magnetic material, the coil formed with a number of turns of an electrically conductive material; and a metal sleeve welded or brazed to the body to enclose the cavity and to form a substantially contiguous electrically conductive surface surrounding the cavity.

22. The inductive coupler of claim 21, further comprising metallic bellows or pressure compensating member to enable the inductive coupler to adjust for pressure or temperature variations in the downhole environment.

23. The inductive coupler of claim 21, wherein the metal sleeve is configured to compensate for pressure or temperature variations in the downhole environment.

24. An inductive coupler for use in a downhole environment, the inductive coupler comprising:

a female inductive coupler portion comprising:

a female portion metallic body at least partially defining a female portion cavity;

magnetic material positioned in the female portion cavity;

a female portion coil adjacent the magnetic material, a non-metallic filler to fill one or more spaces between the female portion metallic body, the magnetic material, and the female portion coil; and a female portion metallic cover immediately adjacent the non-metallic filler and coupled to the female portion metallic body to enclose the female portion cavity, the female portion metallic cover being substantially non-permeable to fluids; and a male inductive coupler portion received within the female inductive coupler portion, the male inductive coupler portion comprising:

a male portion metallic body at least partially defining a male portion cavity;

magnetic material positioned in the mail portion cavity;

a male portion coil adjacent the magnetic material, a non-metallic filler to fill one or more spaces between the male portion metallic body, the magnetic material, and the male portion coil; and a male portion metallic cover immediately adjacent the non-metallic filler and coupled to the male portion metallic body to enclose the male portion cavity, the male portion metallic cover being substantially non-permeable to fluids.

* * * * *